US010688679B2

(12) United States Patent
Küchler

(10) Patent No.: US 10,688,679 B2
(45) Date of Patent: Jun. 23, 2020

(54) DRIVING MODULE WITH IMPROVED MAGAZINE

(71) Applicant: Illinois Tool Works Inc., Glenview, IL (US)

(72) Inventor: Gerhard Küchler, Hamburg (DE)

(73) Assignee: Illinois Tool Works Inc., Glenview, IL (US)

( * ) Notice: Subject to any disclaimer, the term of this patent is extended or adjusted under 35 U.S.C. 154(b) by 60 days.

(21) Appl. No.: 15/867,198

(22) Filed: Jan. 10, 2018

(65) Prior Publication Data

US 2018/0200916 A1 Jul. 19, 2018

(30) Foreign Application Priority Data

Jan. 13, 2017 (DE) ..... 10 2017 100 660

(51) Int. Cl.
*B27F 7/13* (2006.01)
*B27F 7/09* (2006.01)
(Continued)

(52) U.S. Cl.
CPC ..... *B27F 7/13* (2013.01); *B25C 5/1679* (2013.01); *B27F 7/006* (2013.01); *B27F 7/09* (2013.01)

(58) Field of Classification Search
CPC .... B27F 7/13; B27F 7/09; B27F 7/006; B25C 5/1679
(Continued)

(56) References Cited

U.S. PATENT DOCUMENTS 2,908,908 A * 10/1959 Steinmetz ..... A41H 37/02 227/18
4,708,141 A * 11/1987 Inoue ..... A61B 17/1155 227/179.1
(Continued)

FOREIGN PATENT DOCUMENTS

CN 106142241 11/2016
EP 1369214 12/2003

OTHER PUBLICATIONS

Toolmatic® Automated Fastening Systems brochure, by ITW Industry, Nov. 2010 (32 pages).

*Primary Examiner* — Robert F Long
(74) *Attorney, Agent, or Firm* — Neal, Gerber & Eisenberg LLP

(57) ABSTRACT

A driving module for driving fasteners into a workpiece, the fasteners being interconnected via a connection mechanism to form a fastener belt and being magazined and rolled up to form a fastener belt roll, wherein the driving module has a driving apparatus, wherein the driving module has a mounting portion for mounting the driving apparatus on a workpiece bridge, wherein the driving apparatus has a driving drive, which acts on the respective fasteners to be driven with a driving force by way of a driving ram that is displaceable in the driving direction, and wherein a magazine having at least one exit portion is connectable to the driving apparatus; and by way of the exit portion, the fastener belt can be routed out of the magazine, and wherein the magazine has at least one fastening portion for fastening the magazine or parts thereof to the driving apparatus, wherein the magazine has at least two belt roll holders, each for receiving at least one fastener belt roll.

10 Claims, 13 Drawing Sheets

(51) Int. Cl.
*B25C 5/16* (2006.01)
*B27F 7/00* (2006.01)

(58) Field of Classification Search
USPC ..... 227/15–18, 107–109, 140
See application file for complete search history.

(56) References Cited

U.S. PATENT DOCUMENTS 4,898,316 A * 2/1990 McLaughlin ..... B27F 7/13 227/120
4,930,630 A * 6/1990 Habermehl ..... F16B 27/00 206/347
5,199,506 A * 4/1993 Dewey ..... B25C 1/001 173/104
5,269,451 A * 12/1993 Udagawa ..... B25C 5/1627 227/120
5,943,926 A * 8/1999 Habermehl ..... F16B 27/00 206/347
6,123,241 A * 9/2000 Walter ..... B25C 1/08 123/46 SC
6,145,725 A * 11/2000 Omli ..... B25C 5/1693 227/120
6,779,700 B2 * 8/2004 Bruins ..... B25C 1/006 227/120
6,908,022 B2 * 6/2005 Schmitz ..... B25C 5/1693 227/119
2003/0102350 A1 * 6/2003 Liu ..... B25C 5/1693 227/18
2004/0144445 A1 * 7/2004 Cassese ..... B27F 7/006 144/2.1
2006/0289597 A1 * 12/2006 Bruins ..... B25C 5/1693 227/18
2010/0019014 A1 * 1/2010 Rodenhouse ..... B25B 21/002 227/32
2015/0158160 A1 * 6/2015 Kato ..... B25C 1/047 91/35
2016/0288305 A1 * 10/2016 McCardle ..... B25C 1/06
2018/0015767 A1 * 1/2018 Kim ..... B25C 5/06
2018/0126530 A1 * 5/2018 Pomeroy ..... B25C 1/008
2018/0297734 A1 * 10/2018 Cooper ..... B65C 7/003

* cited by examiner

DRIVING MODULE WITH IMPROVED MAGAZINE

PRIORITY

This application claims priority to and the benefit of German Patent Application No. 10 2017 100 660.5, filed Jan. 13, 2017, the entire contents of which are incorporated herein by reference.

FIELD

The present disclosure relates to a driving module for driving fasteners into a workpiece, wherein the fasteners are interconnected by a connecting mechanism to form a fastener belt configured to be magazined and rolled up to form a belt roll, and wherein the driving module is mountable on a tool bridge in particular in the course of industrial production. These driving modules are configured to be used in the production of prefabricated housing modules, for example.

BACKGROUND

With various known driving modules such as the Toolmatic series CT550 distributed by ITW Befestigungssysteme GmbH (ITW Fastening Systems Inc.), the tool bridge must be stopped when the fasteners in the magazine run short. Furthermore, several tools that must be filled at different times are often used on one tool bridge. Therefore, to minimize the number of stops, it is often necessary at a stop to even refill modules whose magazines are not yet completely empty, which results in the fasteners remaining in such magazines being discarded and no longer used.

SUMMARY

One advantage of various embodiments of the present disclosure is to improve upon these disadvantages, and in particular to shorten the duration of machine downtime when refilling fasteners, and most preferably, reducing the number of required stops and, if possible, using all the fasteners in each of the magazines.

This advantage is achieved in particular by a driving module for driving fasteners into a workpiece, wherein the fasteners are interconnected by connecting mechanism to form a fastener belt that is magazined and rolled up to form a belt roll, wherein the driving module has a driving apparatus, wherein the driving module, preferably the apparatus support, if present (as discussed below), has a mounting portion for mounting the driving module on a tool bridge, wherein the driving apparatus has a driving drive that acts on the respective fasteners to be driven by way of a driving ram that can be displaced in the driving direction with a driving force, wherein the driving module is connected to a magazine having at least one exit portion, by way of which the fastener belt can be removed from the magazine by the belt roll, wherein the magazine has at least one fastening portion for fastening the magazine or parts thereof onto the driving module, wherein the magazine has at least two belt roll holders for receiving at least one belt roll.

The advantage is also achieved in particular by methods for driving fasteners into a workpiece, wherein the fasteners are interconnected by connecting mechanisms to form a fasten belt that is magazined and rolled up to form a belt roll, comprising the steps of: (a) mounting the driving module on a tool bridge; (b) automatically routing the fastener belt from the magazine by the belt roll via an exit portion of the magazine that is fastened to the driving module (or driving apparatus thereof) by a fastening portion; (c) displacement or displacing of a driving ram of a driving apparatus and thereby creating a driving force applied to the respective fasteners to be driven, so that the fastener is driven into the workpiece; and (d) using fasteners from belt rolls mounted from two different magazine for the driving operation.

The advantage is additionally achieved in particular by a magazine for a driving module according to the present disclosure and/or a magazine cartridge for a magazine according to the present disclosure.

The capacity of the fasteners available directly on the driving module is more or less doubled in this way, so that it saves on space because a rapid change to a second belt roll is possible when the first belt roll has been used up, whether this change is manual or automatic, because the belt roll need not first be carried to the driving module and suspended there.

The belt roll holders are preferably arranged side by side. The axes of the belt rolls inserted in the magazine into the belt roll holders are preferably essentially coaxial with one another. A belt roll holder preferably includes a compartment in the magazine and/or a predetermined space in the magazine for a belt roll that is preferably separated from the space defining another belt roll holder by way of a partition. The belt roll holder may be arranged permanently in/on the magazine and it can preferably be coupled and uncoupled in the form of a magazine cartridge. It preferably forms a housing surrounding the belt roll at least partially and/or a seat for the belt roll.

The magazine preferably has more than two belt roll holders, for example, three, four, or more belt roll holders.

The connecting mechanism preferably includes a wire, and especially preferably a plastic belt.

The fasteners are preferably nails.

The driving module is preferably mounted on the tool bridge by way of one or more screws in the area of the mounting portion.

The belt roll holder(s) preferably has (have) a centering unit, with at least three rollers that are arranged in a circle and are preferably displaceable radially, on which the belt roller can be placed so that it can rotate.

The magazine preferably has a cover that can preferably be locked onto a cover holder at different heights in order to be adjusted to various nail lengths.

The magazine preferably has a guide arm, preferably spring pre-stressed, and preferably a guide plate, which should ensure proper unwinding of the belt roll.

The driving module is preferably a pneumatically operated driving module.

Preferably, some or all of the mechanisms present on the driving module, which are explained in greater detail below, are controlled by a control unit. The control unit is preferably part of the driving module.

The magazine cartridge according to the present disclosure preferably has one or more features of the magazine cartridge(s) and/or belt roll holders described herein.

In another embodiment of the present disclosure, the belt roll holders are configured as magazine cartridges, and each of the two magazine cartridges has a fastening portion, and the magazine cartridges can be uncoupled from the driving module, preferably being separated from one another.

A magazine cartridge can be replaced easily and quickly in this way.

Each of the two magazine cartridges preferably has a centering unit, as described above, and/or covers and/or a guide arm.

The driving module preferably has a coupling rail for each cartridge, into which a corresponding coupling rail of the cartridge is inserted in order to connect the cartridge.

In another embodiment of the present disclosure, the belt roll holders can be positioned in alternation—i.e., when the one belt roll holder is in the dispensing position, the other belt roll holder(s) is (are) in the reserve position—the dispensing position, in which the fasteners are lifted from the belt roll held on the belt roll holder onto the driving apparatus, and a reserve position.

In another preferred method according to the present disclosure, the belt roll holders are positioned accordingly.

The dispensing of fasteners out of the belt roll holders is facilitated in this way, i.e., a simpler transport mechanism that carries the fastener belt from the magazine to the driving apparatus can be used because a position for the dispensing has been defined.

The belt roll holders can preferably be positioned in the dispensing position and the reserve position by way of a displacement which is preferably directed essentially at a right angle to the driving direction.

In another embodiment of the present disclosure, the driving module has a magazine changing mechanism with a magazine changing actuator that is preferably operated electrically or pneumatically or hydraulically, by way of which the belt roll holders can be positioned in the dispensing position and the reserve position. In another preferred method according to the present disclosure, the belt roll holders are positioned accordingly.

In this way, there can be an automatic change between the positions.

In another embodiment of the present disclosure, the driving module has a feed mechanism for the fastener belt and a threading mechanism, wherein the threading mechanism is equipped to carry out a threading operation, in which the start of the one fastener belt of the one belt roll is transferred from one of the two belt roll holders to the feed mechanism when the other fastener belt of the other belt roll from the other one of the two belt roll holders runs short or is used up. In another preferred method according to the present disclosure, a corresponding threading operation takes place when one of the two fastener belts runs short or is used up.

This permits a fully automatic change from one belt roll holder with a spent belt roll to a new belt roll holder with a fresh belt roll. Therefore, this doubles the capacity of the fasteners that can be driven in continuous operation without user interaction.

The feed mechanism is preferably equipped to further convey a fastener belt inserted into it with each renewed driving movement of the tool of a fastener.

The threading mechanism preferably has an actuator-operated traction and/or thrust element, preferably a towing hook, which is equipped for coupling onto one of the fasteners or onto the connecting mechanisms at the start of the fastener belt, preferably to hook the threading mechanism there and to then insert it into the feed mechanism, preferably as far as the end of the previous fastener belt, which is still inserted into the feed mechanism.

A threading operation preferably takes place after a belt roll holder-positioning operation. The threading operation preferably takes place after positioning of the belt roll holder, which preferably takes place by way of the magazine changing mechanism. The start of the respective fastener belt, which is inserted into the respective belt roll holder that was most recently positioned in the dispensing position, is preferably transferred.

The driving module preferably has a sensor, preferably an induction sensor, preferably in the area of the feed mechanism, for detecting the passage of the last fastener of a fastener belt.

In another exemplary embodiment of the present disclosure, each one of the two belt roll holders has a starting portion, and each of these starting portions has a holder, preferably secured to prevent reversing, into which the start of the fastener belt can be inserted. In another preferred method according to the present disclosure, the start of the fastener belt is inserted accordingly.

In this way, the fastener belt can be brought into a predefined position, from which the threading mechanism can then receive the start of the belt in a recently filled belt roll holder.

The holder preferably has a snap wedge, preferably manually releasable, to prevent reversing.

In another exemplary embodiment of the present disclosure, the feed mechanism has a plurality of feed elements distributed along the feed direction and a plurality of restraint elements distributed along the feed direction. In another preferred method according to the present disclosure, the fastener belt is conveyed with a corresponding feed mechanism, preferably with each driving operation.

In this way, the spent fastener belt that is exiting and the new fasteners or fastener belt entering, which are consequently not interconnected, are reliably transported jointly at the same speed.

The feed elements are preferably snap wedges, preferably spring loaded, that can be shifted back and forth in the feed direction by way of an actuator.

The restraint elements are snap wedges, preferably stationary with respect to the feed direction and preferably spring loaded.

In another embodiment of the present disclosure, the feed elements and/or the restraint elements are held on a carrier part wherein the carrier part is pivotable in order to make a fastener belt inserted into the feed mechanism accessible or more readily accessible.

The carrier part is preferably mounted pivotably about a hinge on the driving module.

In another embodiment of the present disclosure, the driving module has an apparatus support, and the driving apparatus is arranged on the apparatus support, and the driving apparatus as such can be brought by way of an advancing movement drive, up to the respective workpiece in an advancing movement, preferably being pressable against the workpiece and guided for this purpose via an apparatus guide on the apparatus support, so that it is displaceable in the driving direction.

The advancing drive is preferably embodied as a wedge drive, i.e., the driving apparatus can be raised and lowered by way of the displacement of a wedge perpendicular to the driving direction, wherein the wedge is situated above the driving apparatus.

In another embodiment of the present disclosure, the magazine is coupled to the apparatus support in such a way that a belt roll inserted into the magazine, essentially preferably completely, is decoupled from the approaching movement of the driving apparatus.

It is possible in this way to use a larger magazine with a higher capacity for fastener. Due to the decoupling, the weight of the fasteners is not moved concurrently each time the driving apparatus is advanced, which thus saves energy and forms puts a lower load on the components, so that a greater magazine weight can be managed due to the increased magazine capacity.

This embodiment with an otherwise ordinary magazine is already suitable for rolled-up belts for fasteners (i.e., without multiple belt roll holders) for increasing the capacity of the magazine without any major negative side effects and thereby reducing the number of stops for refilling the magazine. Therefore, it is not necessary for the magazine to have at least two belt roll holders, each for accommodating at least one belt roll.

The phrase "essentially decoupled" is preferably understood to mean that the core of the roll or the midpoint of the roll is static and thus the portion of the roll that is still rolled up is also static, while the unrolled part of the belt can be moved along concurrently.

In another embodiment of the present disclosure, the exit portion of the magazine is mounted so that it is displaceable with respect to the fastening portion of the magazine, preferably being mounted, so that it is displaceable in parallel with the advancing motion.

It is possible in this way to produce a reliable routing of the fastener belt to the driving apparatus moving in relation to the magazine. The exit portion of the magazine or of the belt roll holder is preferably coupled to the driving apparatus in such a way that the exit portion moves along in parallel with the advancing motion. In the presence of a threading mechanism in particular, it is advantageous if the exit portion of the magazine is arranged so that it is stationary with regard to the forward mechanism and the driving apparatus because of its displaceability, such that there can then be a reliable automatic transition to a fresh belt roll on the other belt roll holder.

Additional features and advantages of the present disclosure are described in, and will be apparent from, the following Detailed Description and the Figures.

BRIEF DESCRIPTION OF THE FIGURES

The present disclosure will now be illustrated further on the basis of drawings as examples, in which:

FIGS. 1*a* and 1*b* show a basic diagram of an example driving module according to the present disclosure in the condition in which it is mounted on the tool bridge, wherein FIG. 1*a* shows a driving module having two magazine cartridges, and FIG. 1*b* shows a driving module with a pressure drive and with the magazine decoupled from the pressing movement;

FIGS. 2*a* and 2*b* show the driving module 1, once in the condition with the driving apparatus 20 advanced (FIG. 2*a*), and once in the condition with the driving apparatus 20 raised (FIG. 2*b*);

FIG. 3*a* shows a view without the attached magazine cartridges 31 and 31';

FIG. 3*b* shows a view with the magazine cartridges 31 and 31' attached;

FIG. 4*a* shows a decoupled magazine cartridge 31 without the cartridge cover;

FIG. 4*b* shows a detailed rear view of an area of the magazine cartridge 31 with the exit portion 33 and the fastening portion 32;

FIGS. 4*c* and 4*d* show the magazine cartridge 31 with the cover attached, illustrating the displaceability of the exit portion 33 with respect to the remaining cartridge 31, wherein FIG. 4*c* shows a first displacement condition, and FIG. 4*d* shows a second displacement condition;

FIGS. 5*a* and 5*b* show in detail the area of the driving module 1, in which the threading mechanism 60 is arranged, from the rear, and this is shown in two conditions; and FIGS. 6*a*, 6*b*, and 6*c* show the feed mechanism 70 of the driving module 1 in isolation, shown here in two different conditions (i.e., FIGS. 6*a* and 6*b*) and in sectional views.

DETAILED DESCRIPTION

Figure 1A:
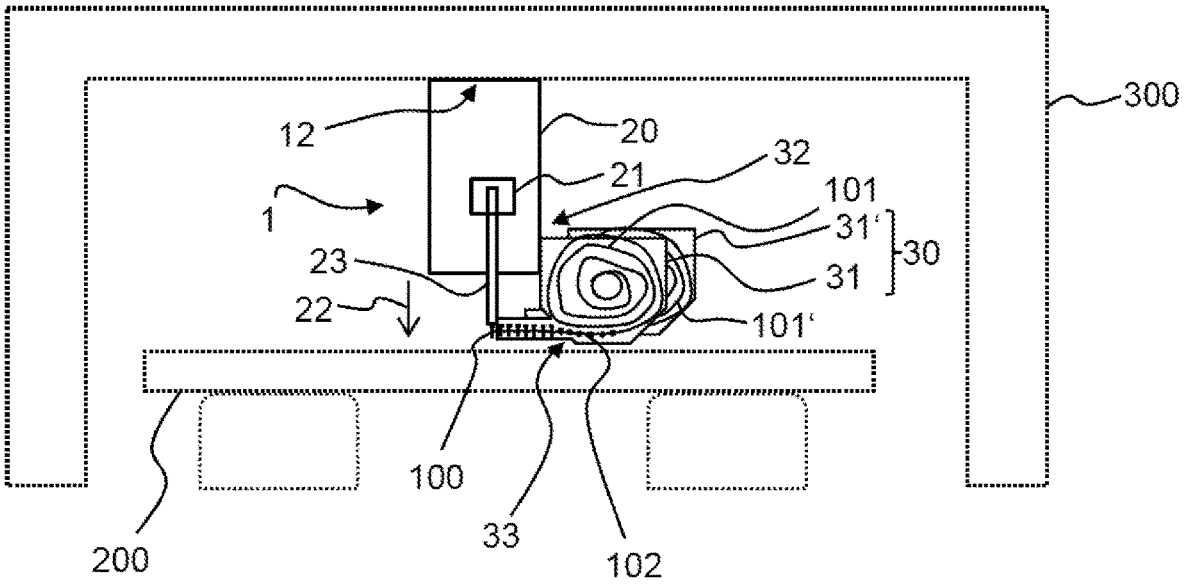

The driving module 1 according to FIG. 1*a* is a driving module 1 for driving interconnected sets of fasteners 100 into a workpiece 200, wherein the fasteners 100 are interconnected by a connecting mechanism, wherein each set of the fasteners 100 are connected to one another to form a fastener belt 102, and each of the fastener belts is rolled up to form belt rolls 101 and 101' that are magazined. The driving module 1 has a driving apparatus 20 and a mounting portion 12 for mounting the driving module 1 on a tool bridge 300. The driving apparatus 20 has a driving drive 21 configured to act with a driving force on the respective fastener 100 to be driven and does so by way of a driving ram 23 that is displaceable in the driving direction indicated by arrow 22 with a driving force. A magazine 30 having at least one exit portion 33 and 33' is fastened to the driving module 1. By way of this exit portion, the fastener belt 102 can be advanced out of the magazine 30 from the belt roll 101. The magazine 30 has at least one fastening portion 32 for fastening the magazine 30 or parts thereof on the driving module 1. The magazine 30 also has two belt roll holders 31 and 31' each for receiving a respective one of the belt rolls 101 and 101'. The fasteners here are nails, which are connected to a plastic belt.

Figure 1B:
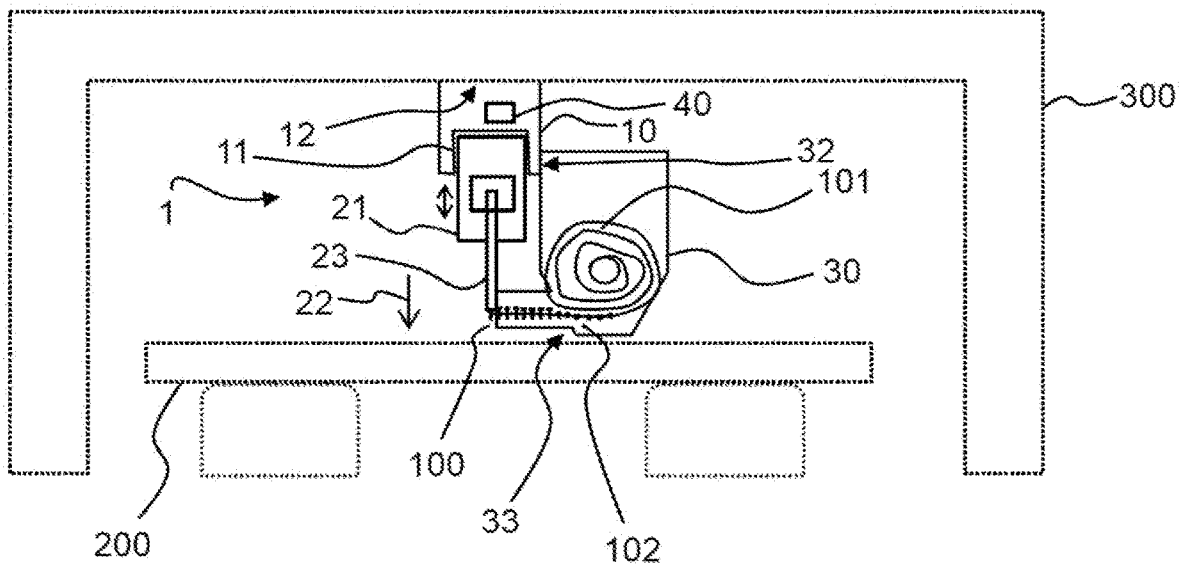
Figure 2A:
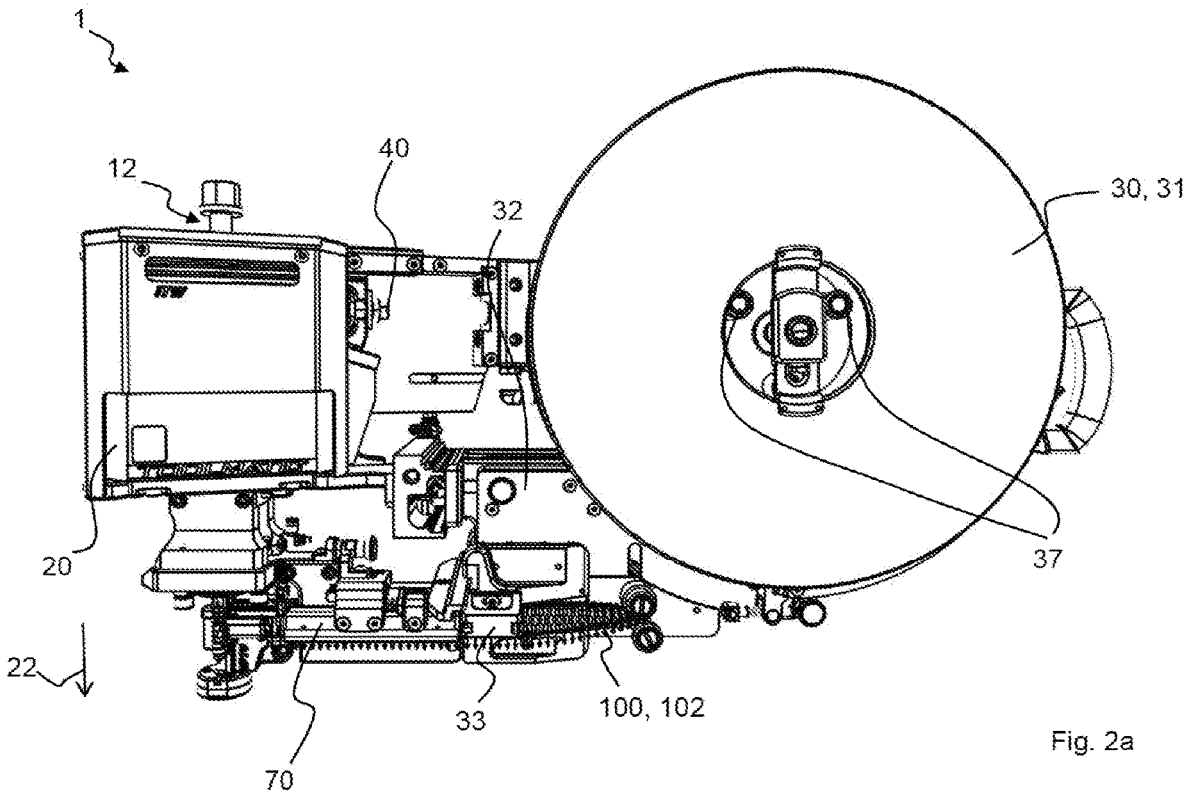
FIGS. 2*a*, 2*b*, 3*a*, 3*b*, 4*a*, 4*b*, 4*c*, 4*d*, 5*a*, 5*b*, 6*a*, 6*b*, and 6*c* show perspective views of a driving module, which combines the properties of the driving modules from FIGS. 1*a* and 1*b* and also has other advantageous features, wherein the belt roll holders 31 and 31' are configured as magazine cartridges.
Figure 2B:
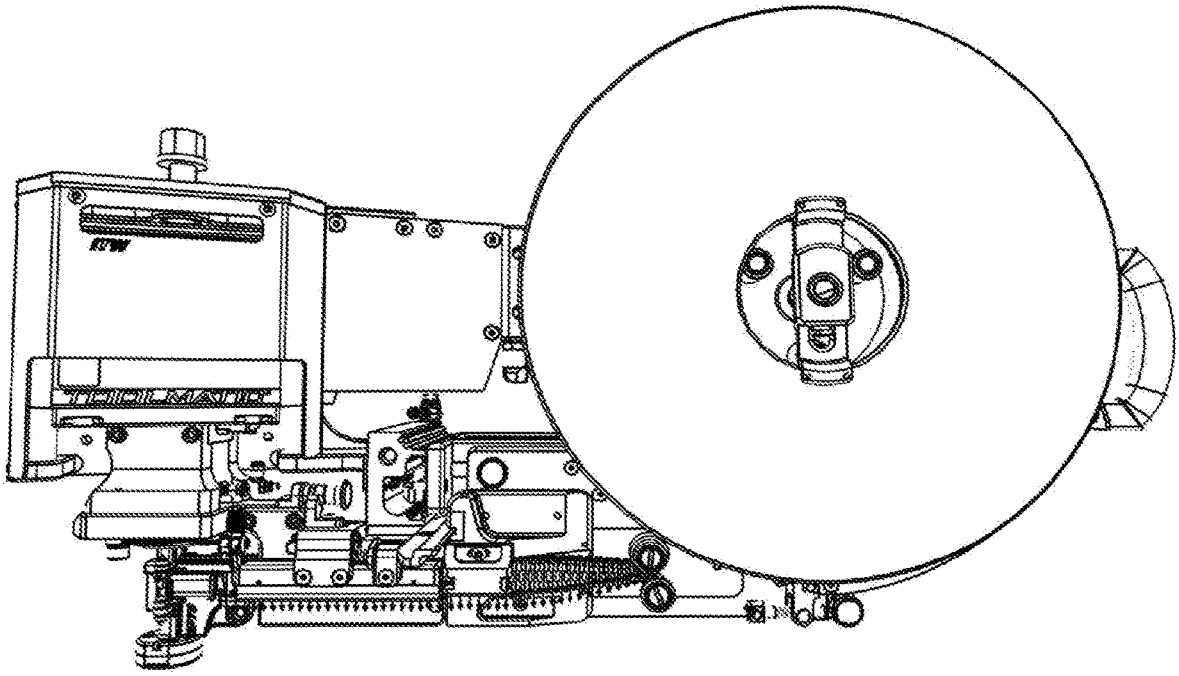

The driving module 1 according to FIG. 1*b* also has an apparatus support 10 in addition to the one from FIG. 1*a*, and the driving apparatus 20 is arranged on the apparatus support 10. The driving apparatus 20 can be advanced as such by way of an advancing drive 40 to the respective workpiece 200 in an advancing movement. For this purpose, it is guided displaceably by way of an apparatus guide 11 on the apparatus support 10 in the driving direction 22. The magazine 30 is coupled to the apparatus support 10 in such a way that a belt roll 101 inserted into the magazine 30 is essentially decoupled from the advancing movement of the driving apparatus 20. It is not necessary here for the magazine 30 to have at least two belt roll holders 31 and 31', each to accommodate at least one belt roll, but this is very advantageous.

The exemplary embodiment shown in FIGS. 2*a* to 6*c* also has in particular the following features.

The belt roll holders 31 and 31' are embodied as magazine cartridges, and each one of the two magazine cartridges has a fastening portion 32 and 32', respectively. They can be decoupled separately from one another from the driving module 1. The driving module 1 has coupling rails 13 and 13' (see FIG. 3*a*) for cartridges 31 and 31' into which a corresponding coupling rail 36 (see FIG. 4*b*) of the respective cartridge 31 or 31' is inserted to couple that cartridge 31 or 31'. The belt roll holders 31 and 31' are each dispensed to the driving apparatus 20 from the belt rolls 101 and 101' held on the belt roll holders 31 and 31' and can be positioned in a reserve position. The displacement direction required for this is indicated by a double arrow in FIGS. 2*a* and 2*b* and is oriented essentially at a right angle to the driving direction indicated by arrow 22. The driving module 1 has a magazine changing mechanism 50 with a pneumatically operated magazine changing actuator 51 (see FIG. 3*a*), by way of which the belt roll holders 31 and 31' can be positioned in the dispensing position and the reserve position. The driving module 1 also has a feed mechanism 70 for the fastener belt 102 and a threading mechanism 60.

The feed mechanism 60 is equipped to carry out a threading operation, in which the start of the one fastener belts 102 and 102' of the one belt rolls 101 and 101' is transferred from one of the two belt roll holders 31 and 31' into the feed mechanism 70 when the other fastener belts 102 and 102' of the other belt rolls 101 and 101' from the other one of the two belt roll holders 31 and 31' is running short or has been used up.

Figure 3A:
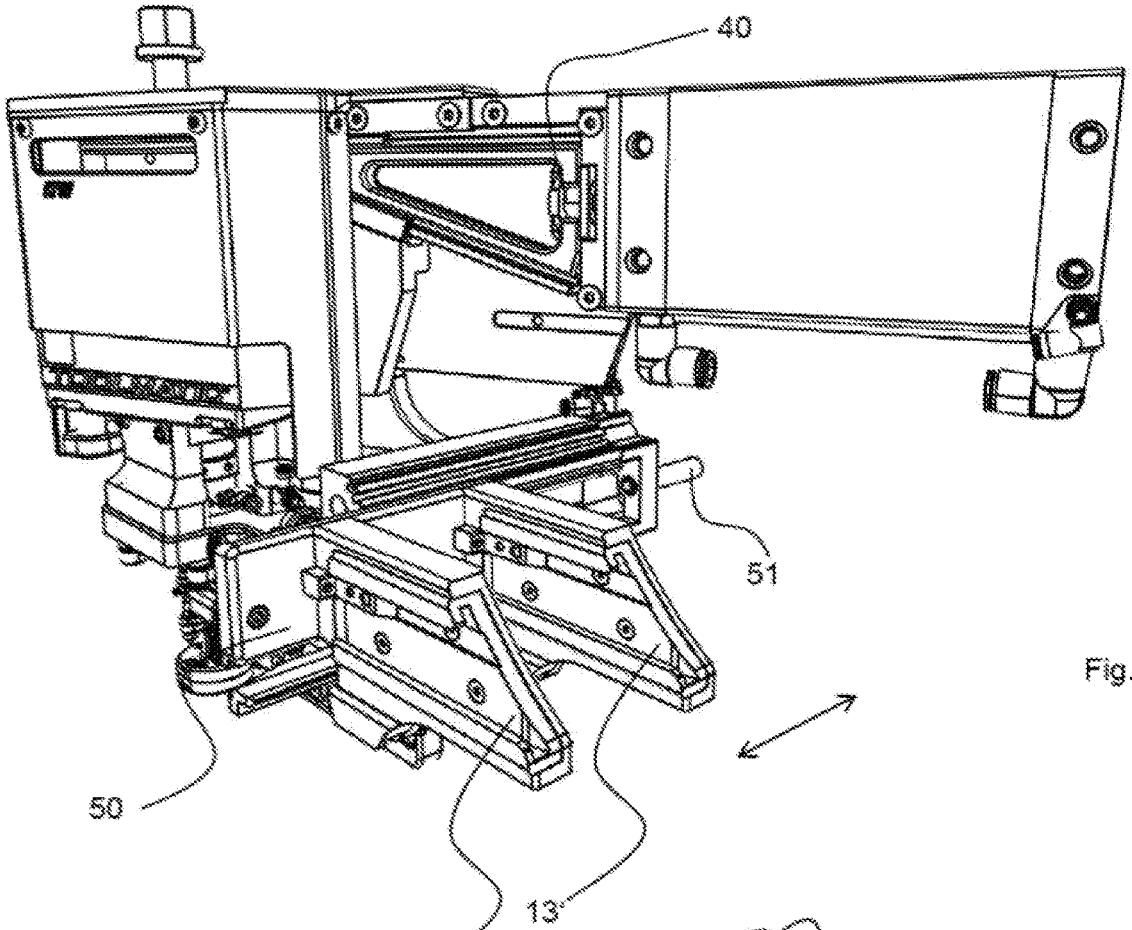
Figure 3B:
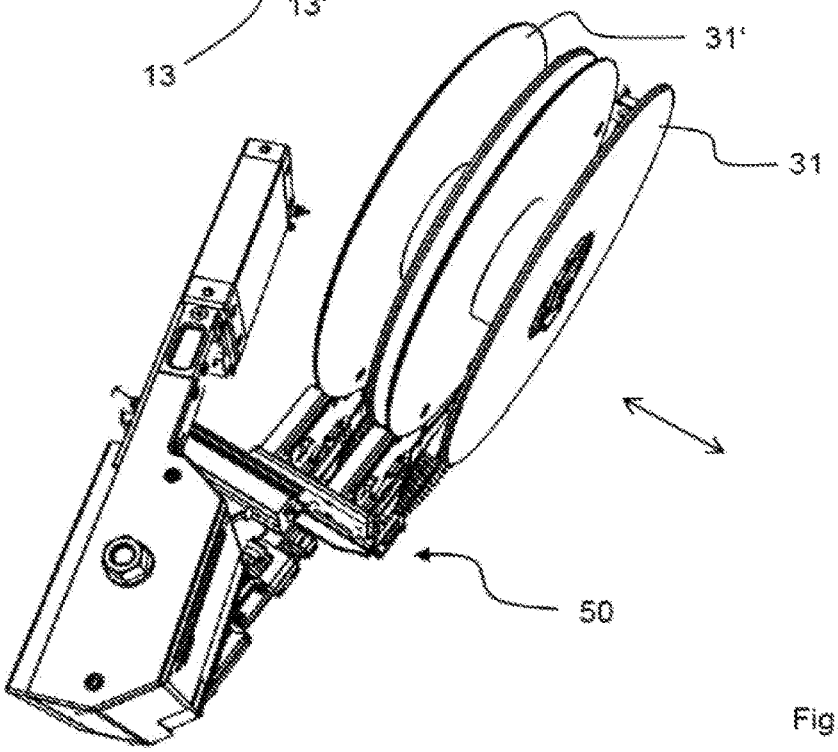

It can also be seen well in FIG. 3*a* that in this embodiment the advancing drive 40 is embodied as a wedge drive.

Figure 4A:
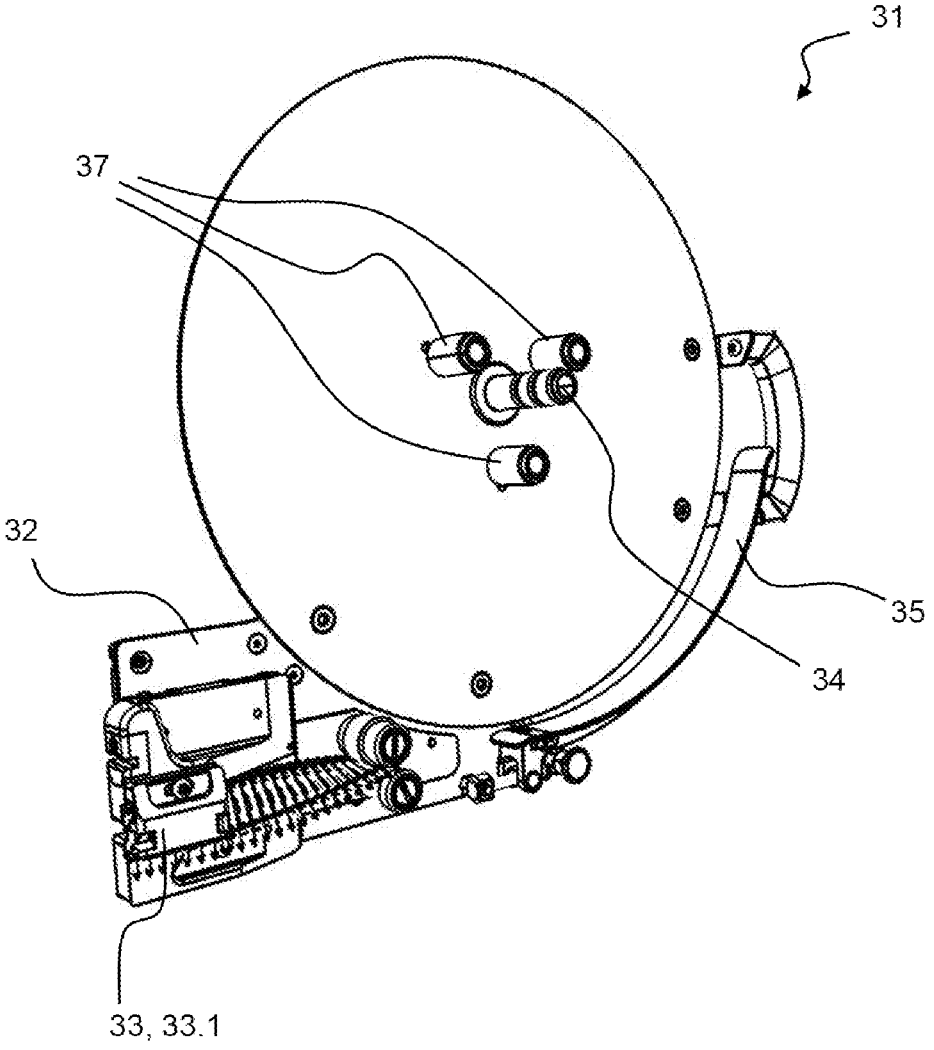
Figure 4B:
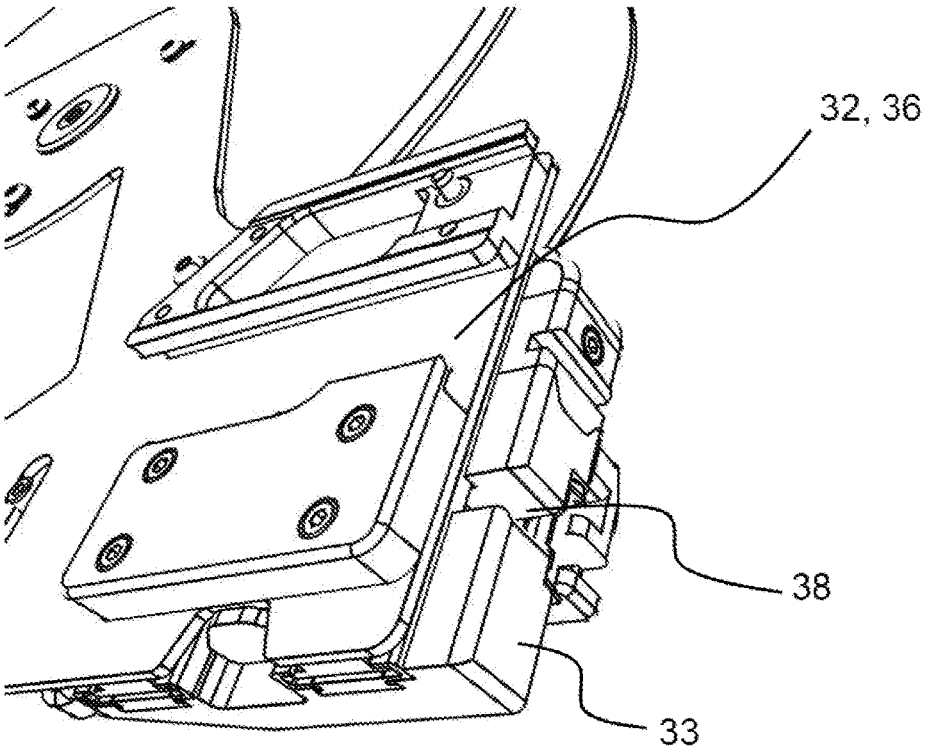

It can be seen well in FIG. 4*a* that the belt roll holders 31 and 31' have a centering unit 37 with three radially displaceable rolls arranged in a circle, such that the belt roll can be placed rotatably on the rolls. The belt roll holders 31 and 31' also each have a cover which can preferably be locked at different levels on a cover holder 34 in order to be adapted to various nail lengths. The belt roll holders 31 and 31' also each have a spring pre-stressed guide plate 35 that should ensure a proper unwinding of the belt roll. Furthermore, each of the two belt roll holders 31 and 31' has a respective exit portion 33 and 33'. These exit portions 33 and 33' each have a holder 33.1 that is prevented from reversing, and into which the start of the fastener belt 102 can be inserted. The holder 33.1 has a snap wedge that can be released manually as the return safety.

Figure 4C:
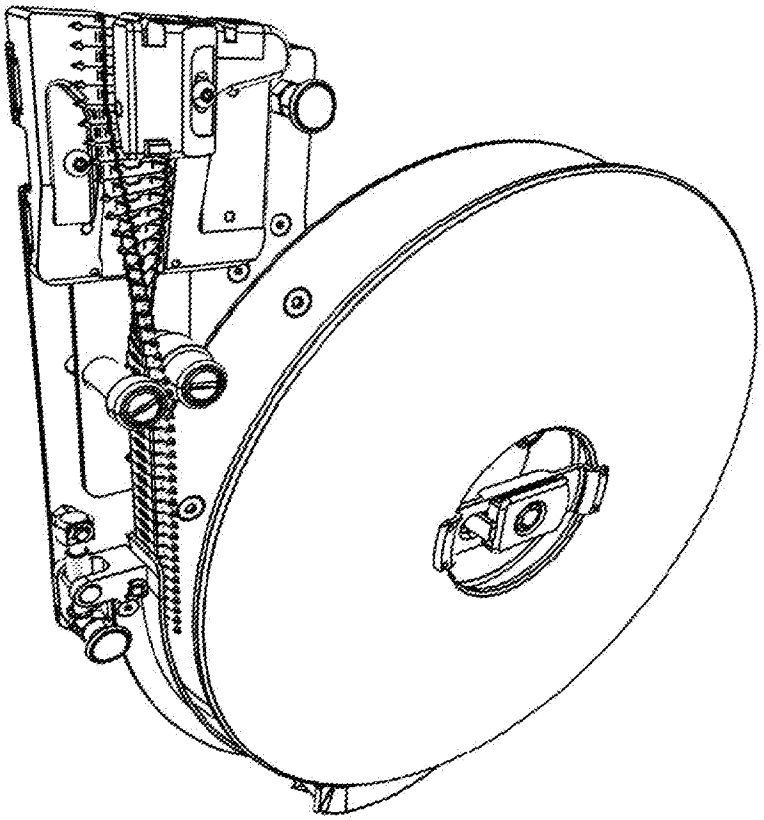
Figure 4D:
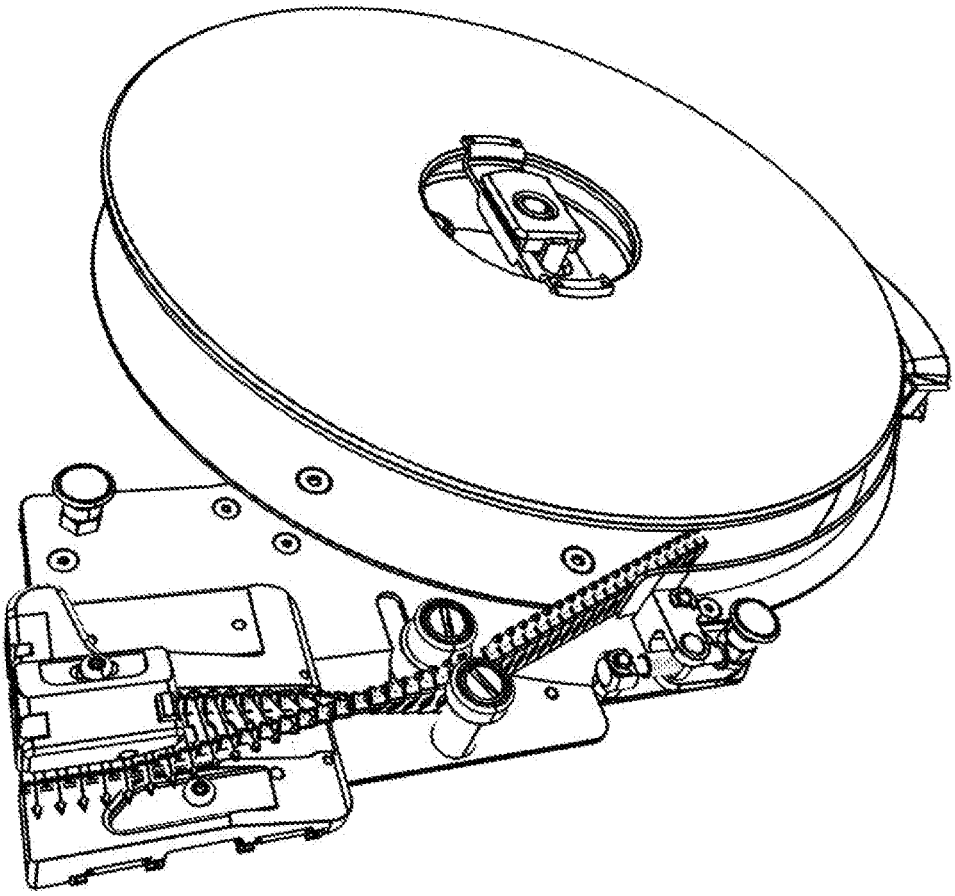

It can be seen well in FIGS. 4*c* and 4*d* that the exit portions 33 and 33' of the belt roll holders 31 and 31' are mounted, so that they are displaceable with respect to the fastening portions 32 and 32' of the belt roll holders 31 and 31' and are mounted so that they are displaceable in parallel with the advancing movement. This is readily apparent by comparing the two figures.

Figure 5A:
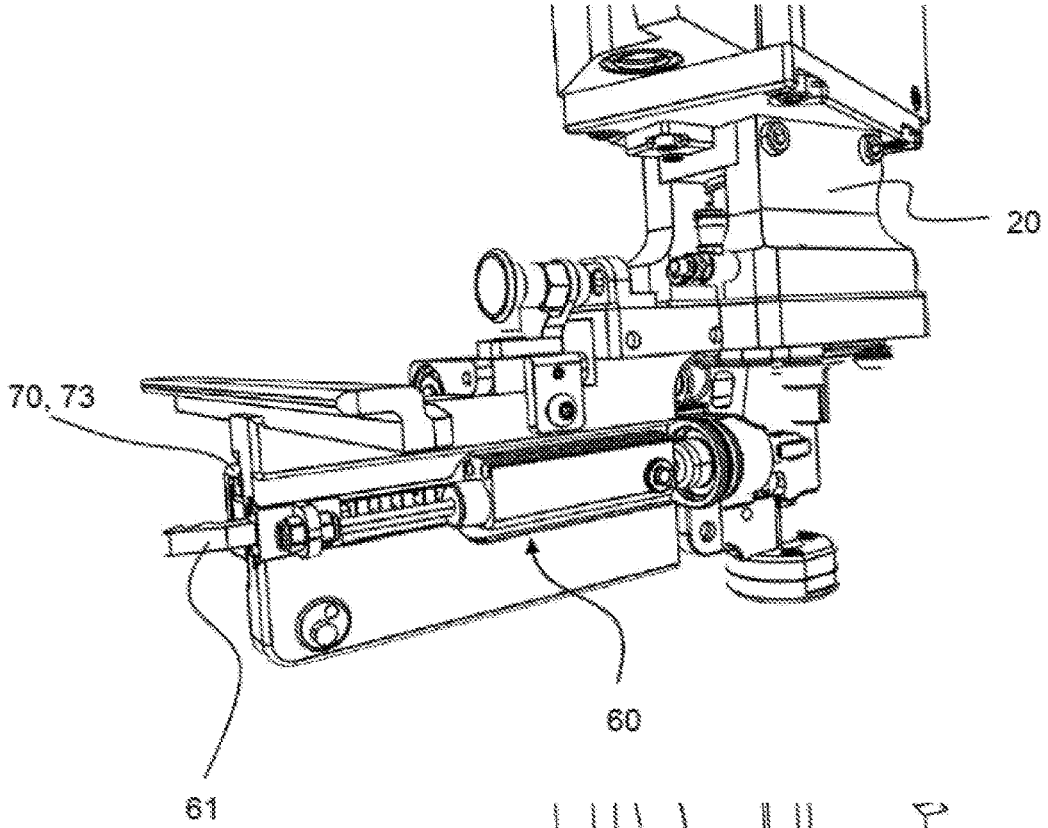
Figure 5B:
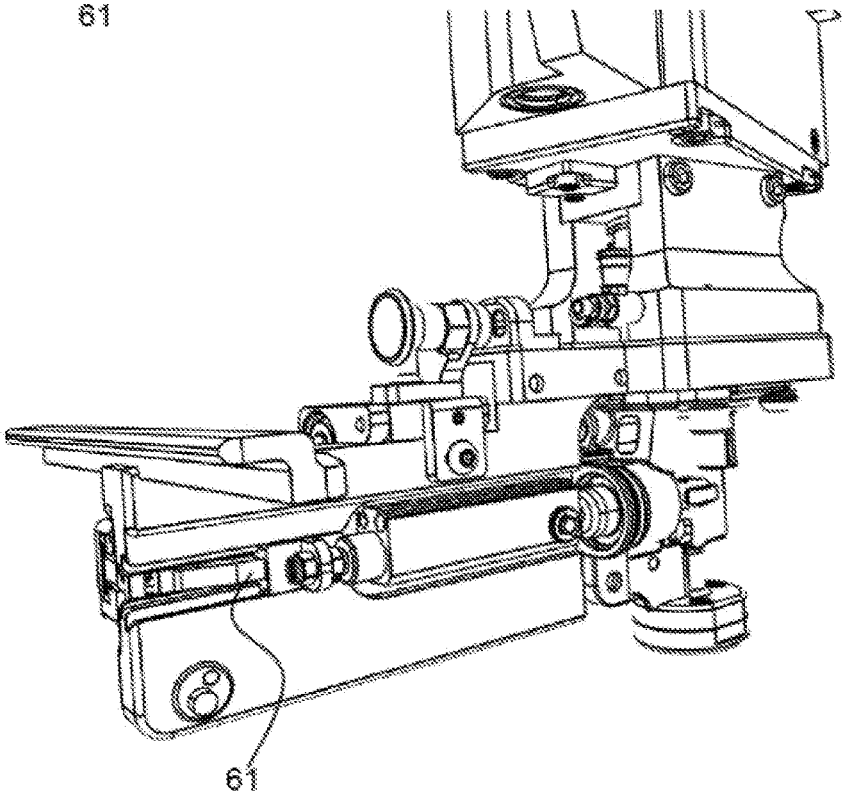

It can be seen well in FIGS. 5*a* and 5*b* that the threading mechanism 60 preferably has an actuator-operated towing hook 61 that is equipped to engage with one of the fasteners 100 at the start of the fastener belt 102 and to pull or push the fastener belt until reaching the end of the previous fastener belt still inserted in the feed mechanism 70. For this purpose, each of the exit portions 33 and 33' of the cartridges 31 and 31' has a groove 38 in the area of the return secured holder 33.1 (see FIG. 4*b*) through which the hook 61 can engage the fastener 100. The towing hook 61 is mounted on a linear actuator.

Figure 6A:
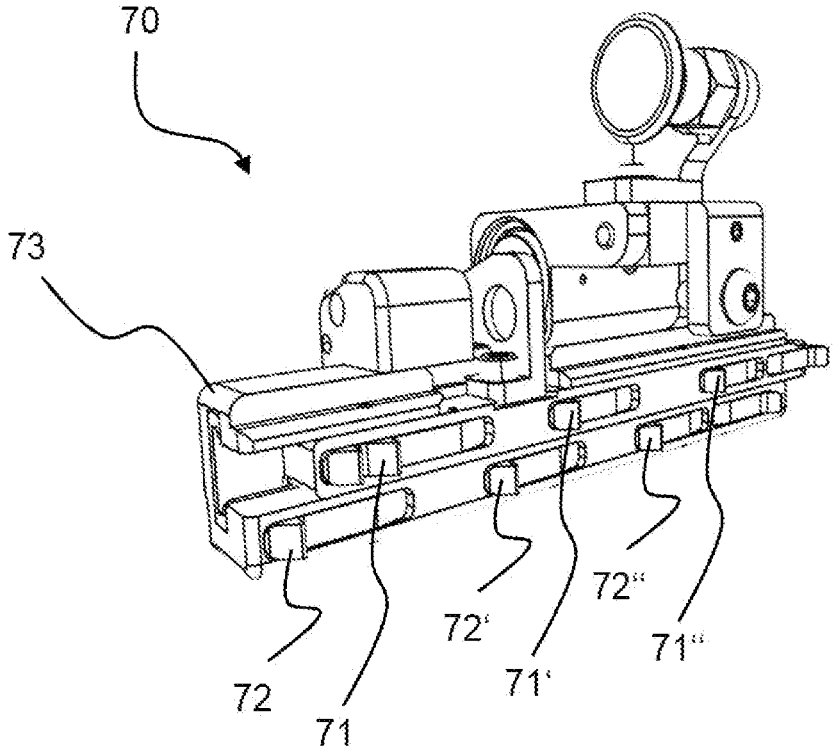
Figure 6B:
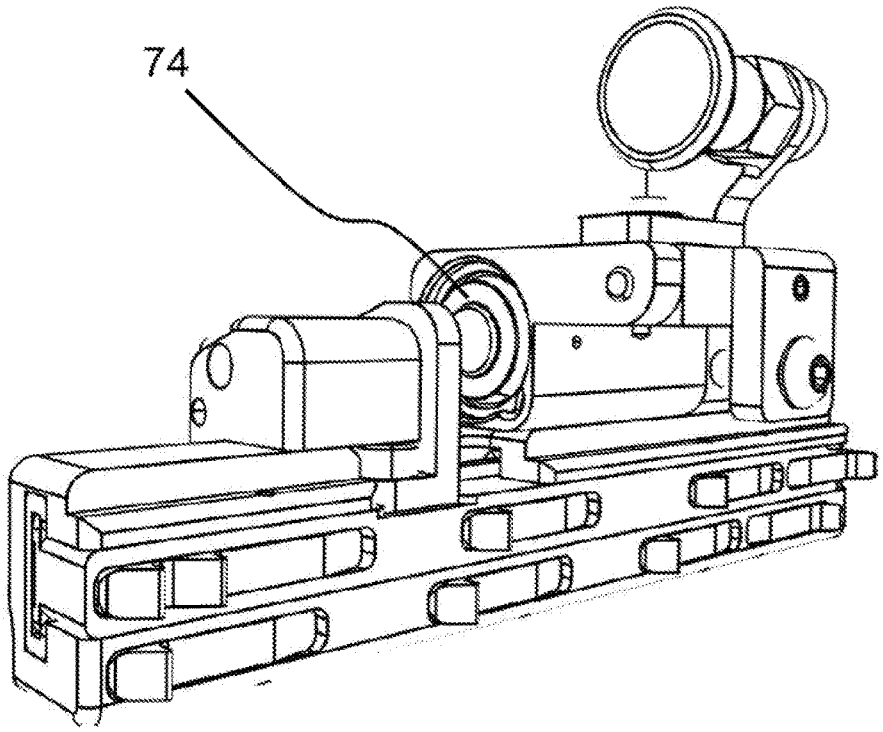
Figure 6C:
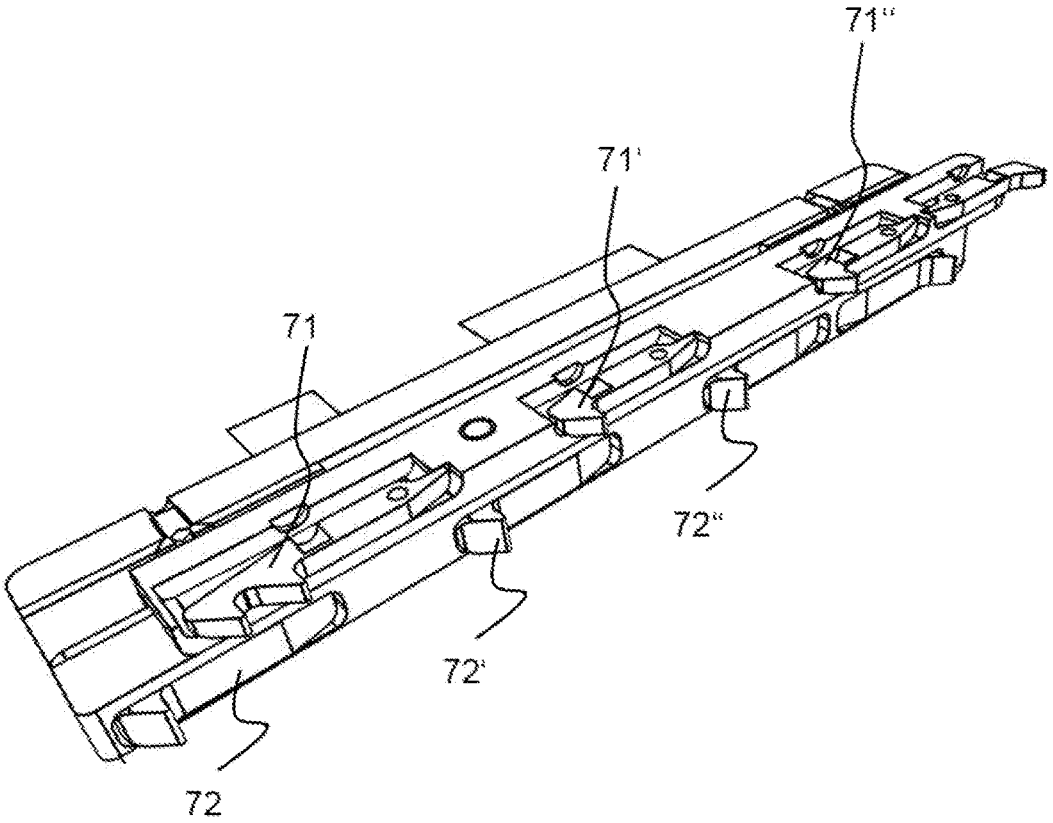

It can be seen well in FIGS. 6*a* through 6*c* that the feed mechanism 70, which is arranged on the other side of the towing hook 61 (see FIGS. 5*a* and 5*b*), has multiple feed elements 71, 71', and 71" distributed along the feed direction and multiple restraint elements 72, 72', and 72" distributed along the feed direction. The feed elements 71, 71', and 71" are spring-mounted snap wedges that can be displaced back and forth in the feed direction by way of a feed actuator 74. The restraint elements 72, 72', and 72" are snap wedges that are stationary with respect to the feed direction and are preferably spring loaded. The mobility of the feed elements 71, 71', and 71" is seen by comparing FIGS. 6*a* and 6*b*. The feed elements 71, 71', and 71" and the restraint elements 72, 72', and 72" are held on a carrier part 73, wherein the carrier part is pivotable to make the fastener belt 102 that has been inserted into the feed mechanism 70 accessible or more readily accessible. The entire module shown in FIGS. 6*a* and 6*b* can therefore be pivoted out of the way because it is mounted on a hinge. FIG. 6*c* shows the mounting of the snap wedges 71, 71', and 71", wherein the springs that press the snap wedges outwardly are not shown here.

It will be understood that modifications and variations may be effected without departing from the scope of the novel concepts of the present disclosure, and it is understood that this application is to be limited only by the scope of the claims.

The invention claimed is:

1. A fastener driving module comprising:

a driving apparatus including a driving drive having a driving punch displaceable in a driving direction to respectively exert a driving forces on each of a plurality of fasteners received from one of two fastener belt rolls, each fastener belt roll including a plurality of fasteners interconnected by a connection mechanism to form a fastener belt that is rolled up to form the fastener belt roll;

a mounting portion configured to mount the driving apparatus to a workpiece bridge; and a magazine connectable to the driving apparatus, the magazine including first and second fastener belt roll holders that are each configured to hold one of the two fastener belt rolls, the magazine having an exit portion through which the fastener belts can sequentially move out of the magazine, wherein the first and second fastener belt roll holders are each positionable to a dispensing position at which fasteners from the fastener belt roll held by that fastener belt roll holder are dispensable to the driving apparatus, wherein the first fastener belt roll holder is positionable in a first reserve position while the second fastener belt roll holder is positioned in the dispensing position, and wherein the second fastener belt roll holder is positionable in a second different reserve position while the first belt roll holder is positioned in the dispensing position.

2. The driving module of claim 1, wherein the fastener belt roll holders include magazine cartridges that each has a fastening portion that enables that magazine cartridge to be decoupled from the driving apparatus.

3. The driving module of claim 1, which includes a magazine-changeover mechanism having a magazine changeover actuator configured to:

cause the first fastener belt roll holder or the second fastener belt roll holders to be positioned in the dispensing position;

cause the first fastener belt roll holder to be positioned in the first reserve position while the second fastener belt roll holder is positioned in the dispensing position; and cause the second fastener belt roll holder to be positioned in the second reserve position while the first belt roll holder is positioned in the dispensing position.

4. The driving module of claim 1, which includes an fastener belt feed mechanism and a threading mechanism, wherein the threading mechanism is configured to perform a threading procedure in which the beginning of one of the two fastener belts is transferred to the feed mechanism after the other fastener belt.

5. The driving module of claim 4, wherein each of the two fastener belt roll holders has a holder configured to hold the beginning of the fastener belt held by that fastener belt roll holder.

6. The driving module of claim 4, wherein the fastener belt feed mechanism includes: (a) a plurality of feed elements distributed along a feed direction, and (b) a plurality of restraint elements distributed along the feed direction.

7. The driving module of claim 6, wherein the feed elements and the restraint elements are held on a carrier part, wherein the carrier part is pivotable to make accessible one of the fastener belts when that fastener belt is placed into the feed mechanism.

8. The driving module of claim 1, which includes an apparatus support, wherein the driving apparatus is disposed on the apparatus support, and wherein the driving apparatus is advanceable toward a workpiece.

9. The driving module of claim 8, wherein the magazine is coupled to the apparatus support such each of the fastener belt rolls held in the magazine are substantially decoupled from the advancing motion of the driving apparatus.

10. The driving module of claim 9, wherein the exit portion of the magazine is mounted so as to be displaceable in relation to a fastening portion of the magazine.

* * * * *